United States Patent [19]

Rasenberger

[11] 3,941,240

[45] Mar. 2, 1976

[54] APPARATUS FOR OPERATING AUTOMATIC CONVEYORS

[75] Inventor: Otto Rasenberger, Goppingen, Germany

[73] Assignee: L. Schuler GmbH, Germany

[22] Filed: Feb. 21, 1974

[21] Appl. No.: 444,570

[30] Foreign Application Priority Data

Feb. 21, 1973 Germany ..... 2308539
July 7, 1973 Germany ..... 2334722

[52] U.S. Cl. ..... 198/218; 198/285; 74/40; 100/215

[51] Int. Cl.[2] ..... B65G 25/04

[58] Field of Search..... 198/218, 241, 285, 220 DA, 198/283; 100/207, 215; 214/1 BB, 1 S; 74/27, 40, 519, 524; 72/405

[56] References Cited

UNITED STATES PATENTS

| | | | |
|---|---|---|---|
| 1,745,855 | 2/1930 | Littlefield | 74/40 |
| 1,996,617 | 4/1935 | Hahn | 74/40 |
| 2,490,881 | 12/1949 | Peters | 74/40 |
| 2,631,457 | 3/1953 | Gilbert et al. | 74/27 |
| 2,645,365 | 7/1953 | Haessler | 214/1 BB |
| 2,834,263 | 5/1958 | Goss | 214/1 BB X |
| 2,997,888 | 8/1961 | Rust, Jr. | 74/40 X |
| 3,016,124 | 1/1962 | Crosby et al. | 198/241 |
| 3,499,334 | 3/1970 | Griesinger | 74/40 |
| 3,529,542 | 9/1970 | Rasenberger | 100/215 |
| 3,760,957 | 9/1973 | Berger | 214/1 BB |

*Primary Examiner*—Evon C. Blunk
*Assistant Examiner*—Richard K. Thomson
*Attorney, Agent, or Firm*—Craig & Antonelli

[57] ABSTRACT

Apparatus for driving an automatic workpiece conveyor in a press train which includes a plurality of linkage members articulated to one another to drivingly interconnect a drive element of a press with a workpiece conveyor. The linkage members are interconnected and configured so as to assure movement of the workpiece conveyor between two end positions, with a predetermined stopping interval at the end position, with a continuously moving press drive element. These linkage members include a coupling point interconnecting two of the members which is constrained to move in a predetermined path including two arcuate sections spaced from one another and having the same radius of curvature, which arcuate sections correspond to the end positions of the conveyor. A secondary linkage system is provided for operating a turning device for turning the workpieces when in the end positions. This secondary system includes a two-arm lever having an adjusting motor for threadably moving two parts with respect to one another to effect turning operations. This two-armed lever is pivotally mounted at a rocker arm of the driving linkage for the conveyor.

12 Claims, 6 Drawing Figures

H
19
19
19
20
20
18
45
45
27
27
44
44
2B
2B
2
2
1
1
4
4

APPARATUS FOR OPERATING AUTOMATIC CONVEYORS

BACKGROUND AND SUMMARY OF THE INVENTION

The present invention relates to apparatus for driving automatic workpiece conveying devices in a press train. More particularly, the present invention relates to such conveying devices which include two standstill positions of the conveyor for facilitating pick up and delivery of the workpiece or articles being conveyed.

In prior art systems of this type, cam mechanisms have been employed substantially exclusively for the operation of such conveyors. Such prior art mechanisms, depending upon the purposes for which they are used, are equipped to operate as a single-cam drive or double-cam drive systems.

Disadvantages arise with such cam disk drive because of the limited power transmission available due to the linear or line contact between the cam disk and rollers cooperating therewith. Further problems arise with these cam disk drives with respect to adjusting the rollers with respect to the cam disks so as to assure contact therebetween. Also, the cam disks themselves are very expensive to manufacture due to the shapes required and the loads which they must withstand. Furthermore, the utilization of cam mechanisms in conjunction with frequently required stroke-increasing means (which stroke-increasing means usually consists of gears and racks) results in a considerably rough running of the machine using the cam disk drive conveyors.

The above-discussed disadvantages of the cam disk drive arrangements are avoided in a simple manner by the present invention. The present invention contemplates the utilization of an articulated drive, without the use of cams. Consequently, the drive of the present invention eliminates the need for the long so-called kingpin, which has heretofore been necessary in conventional cam mechanisms and which is very sensitive to twisting and/or must be of extremely thick dimensions. Such a kingpin has been required in the drive connection of the cam mechanism with the press drive. The use of an articulated drive connection in accordance with the present invention also provides for the possibility of the transmission of large forces while utilizing simple members for the construction of the driving interconnection between the press drive and the conveyor.

Also, with the arrangement of the present invention, stroke-increasing means are no longer necessary, since larger feeding steps can be obtained by articulated members configured as in the present invention, in a given space condition, than previously the case with cam drive mechanisms.

Another important feature of the present invention is the provision of an auxiliary drive mechanism for turning operations and the like, which auxiliary drive mechanism is interconnected with the articulated drive for the conveyor, in a particularly simple and useful manner.

In a preferred embodiment of auxiliary drive for turning operations, a two-armed lever with a guide means extending in the longitudinal direction thereof past the axis of rotation is connected for rotation with a rocking lever which forms part of the driving linkage for the conveyor. A slide block is displaceably arranged in this guide means and is provided with a pin to articulate a coupling rod thereto for driving a turning device.

An important advantage of this type of drive for a turning device resides in that the two positions wherein the motion of the conveyor comes to a standstill, resulting from the design of the articulated drive connection for the conveyor, can also be utilized for the pick up and delivery of the parts in the turning device. Furthermore, the adjustment of the slide block in the guide means to various spacings from the axis of rotation of the lever in its two arms makes it possible, on the one hand, to obtain differing swivel angles of the turning device, and on the other hand, to obtain selective pivoting of the turning device into respective opposite directions.

Preferably, the slide block has an internal thread engaged by an adjusting spindle rotatably supported in the lever. The mating of the internal thread and the thread of the adjusting spindle is preferably self-locking. Further, a motor is preferably attached to the lever, which motor is in driving connection with the adjusting spindle. With these arrangements, the variation of the slide block setting in the lever guide means may be facilitated also during operation of the apparatus.

For further background information on the environment with which the preferred embodiments of the present invention are particularly concerned, see U.S. Pat. Nos. 1,426,039; 2,352,632; 2,929,485; 3,105,399; 3,529,542; 3,499,334; and 3,707,908.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
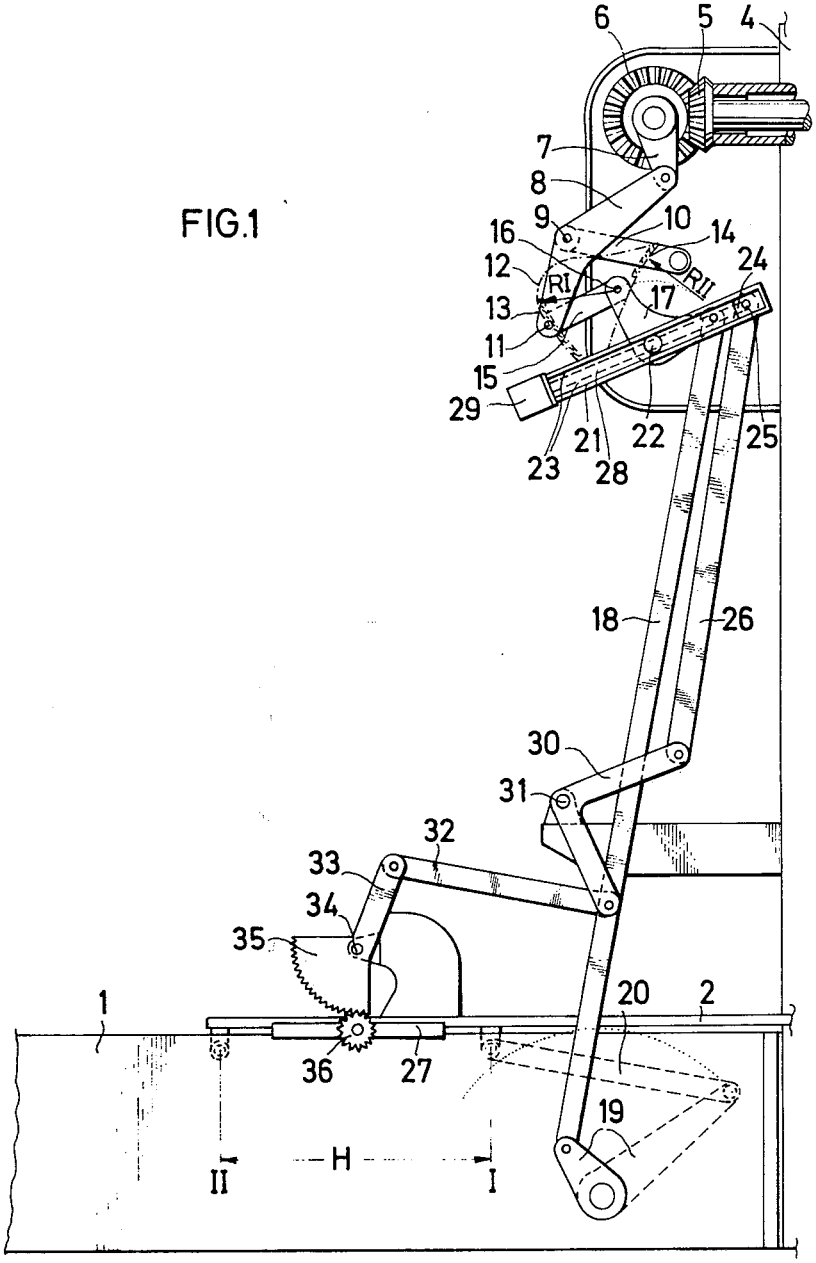
FIG. 1 is a side schematic view of a first embodiment of a conveying apparatus constructed in accordance with the present invention.
Figure 1A:
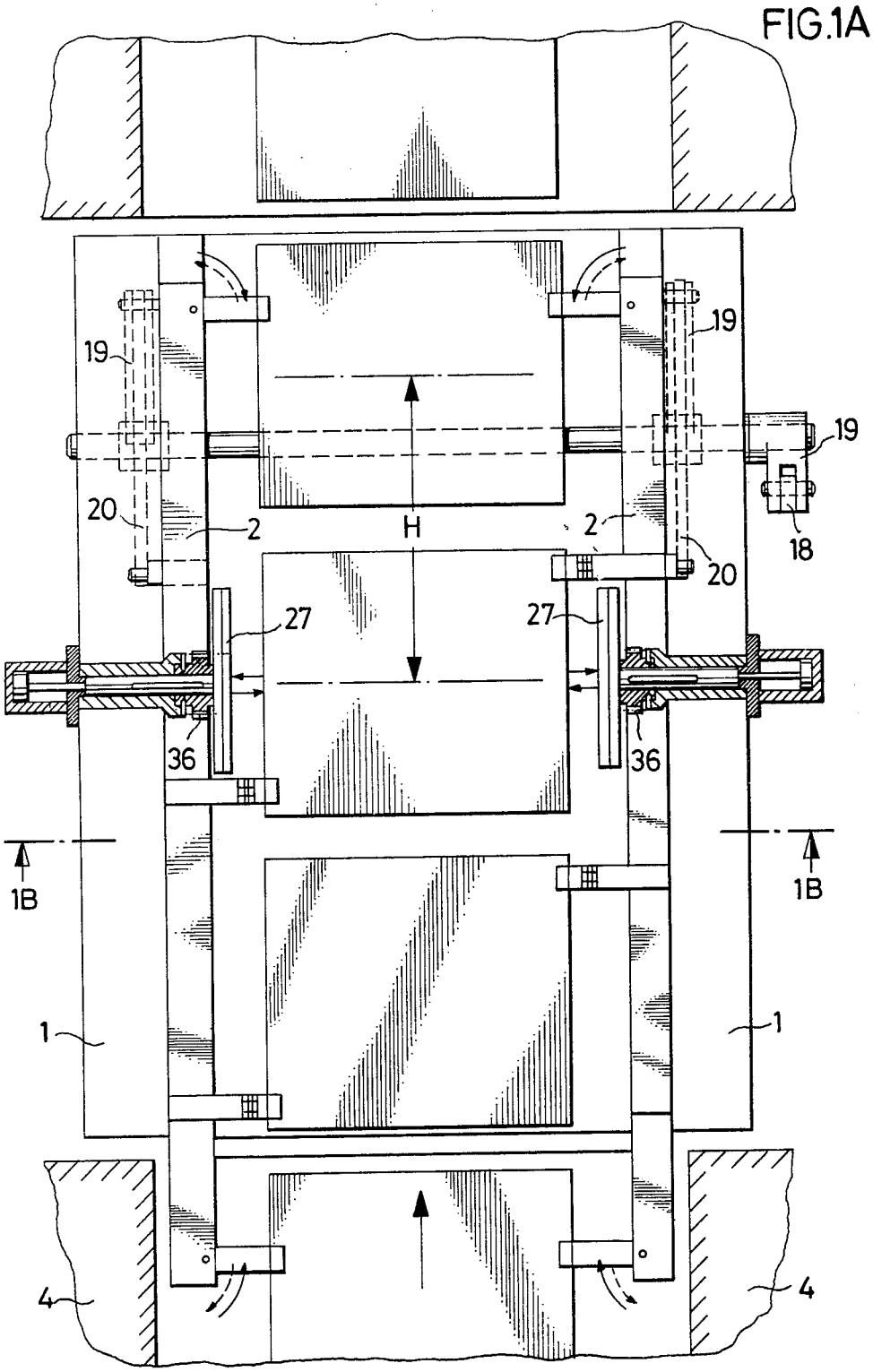
FIG. 1A is a partial sectional view taken in the downward direction of FIG. 1 and along line 1A—1A of FIG. 1B.
Figure 1B:
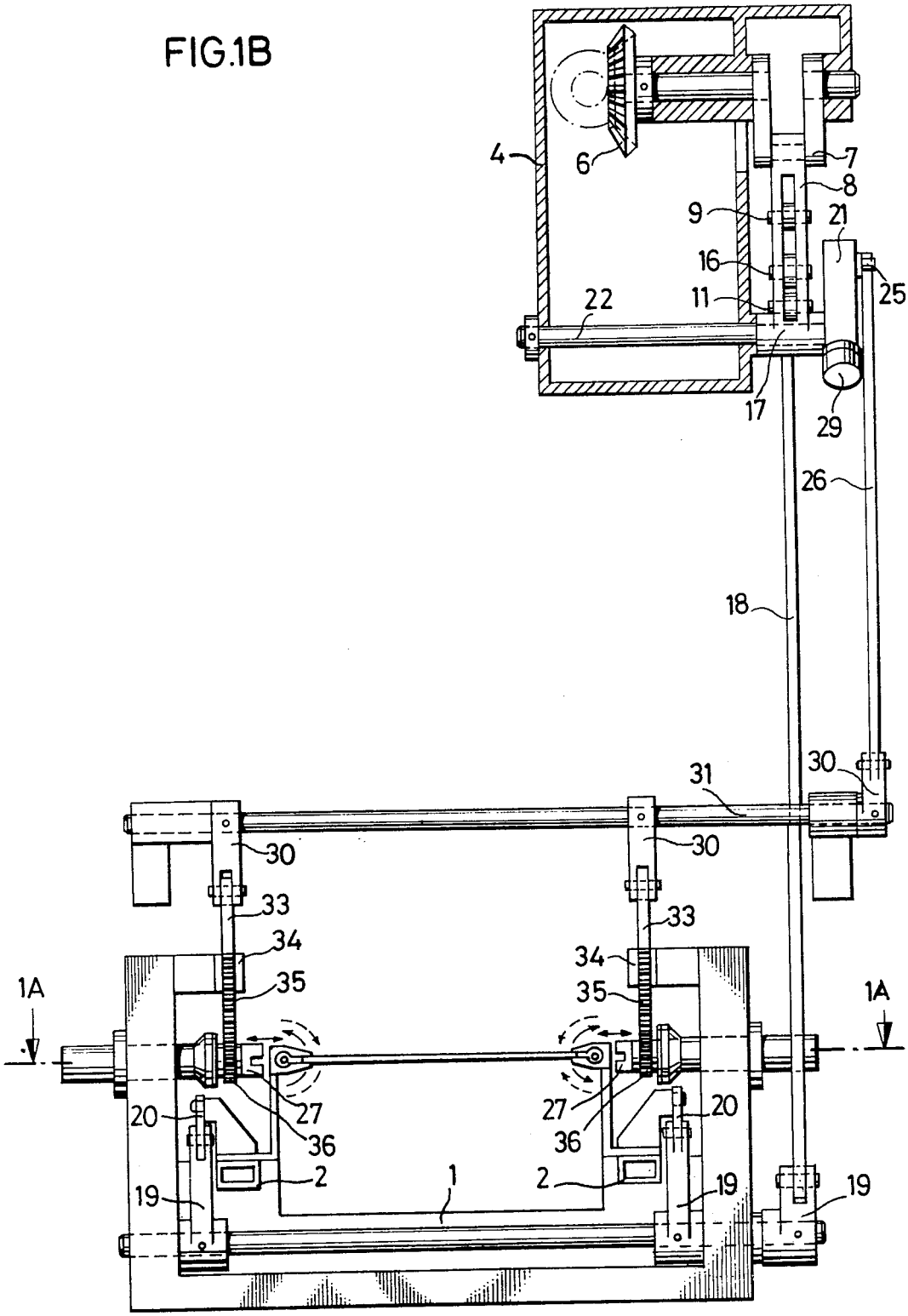
FIG. 1B is a view taken in the direction from left to right of FIG. 1 and along line 1B—1B of FIG. 1A.

Throughout the various views, like reference numerals are used to indicate like structures.

The driving forces for the conveying and turning device of the present invention is derived from a gear system operating a press schematically indicated at reference numeral 4, by way of a bevel drive 5, 6 and an operating crank 7 connected therewith. In this connection, attention is directed to the above-mentioned U.S. Pat. No. 3,707,908, which illustrates more details of a multiple station press wherein a press drive gear 8 is depicted in FIG. 1 which corresponds to the drive 3 of FIG. 1 of the present application.

A coupler 8 is articulated to operating crank 7 and is hingedly supported in an end point 9 of a rocker arm 10. The other end of the rocker arm 10 is articulated in a fixed point at the press 4. The coupler 8 is extended past the end point 9 to a coupling point 11, which coupling point 11 moves, in dependence on the rotation of the operating crank 7, along a coupling curve 12. A guide or steering element 15 is connected to the coupling point 11 at one end and at the other end in a pivot point 16 with a two-armed angled rocking lever 17. This two-armed rocking lever 17 is pivotably secured in a fixed point at the press 4.

A linkage member 18 is articulated to the end of the rocking lever 17 facing away from the pivot point 16 such that the movements of linkage 18 are transmitted to the feed slide 2 which is displaceable along a slide support 1, by way of an angle lever 19 pivotably mounted in a fixed point and by way of a fishplate 20.

Due to the configuration of the articulated drive connection (with the various linkage members being shaped and dimensioned as illustrated in the drawings relative to one another), the coupling curve or predetermined path 12 of coupling point 11 exhibits two arcuate curve sections 13, 14 having an equal radius $R_I = R_{II}$. The radius $R_I$, $R_{II}$, is equal to the effective length of the guide element 15 such that the motion of the rocking lever 17 is brought to a standstill in certain positions during which the coupling point 11 traverses the curved sections 13, 14. During these arrested-motion or standstill conditions, the feed slide 2 is at a standstill in the respective stop points I, II, representing the terminal positions of the movement of the conveyor about the advancing stroke H. These standstill conditions or positions are designed into the articulated drive system as described above in order to facilitate pick up and delivery of parts or workpieces being conveyed.

A two-armed lever 21 is connected for rotation with the rocking lever 17. A guide means 23 extends in the longitudinal direction of two-armed lever 21 over the common axis of rotation 22 of the rocking lever 17 and lever 21. A slide block 24 is displaceably arranged in guide means 23, which slide block is provided with a pin 25 to articulate thereto a coupling rod 26 for driving a turning device 27. An adjusting spindle 28 engages an internal thread formed in slide block 24 and is rotatably disposed in the lever 21. In this arrangement, the mating of the internal thread in the slide block 24 with the thread of the adjusting spindle 28 is fashioned to be self-locking. At one end of the lever 21, a motor 29 is mounted which is in driving connection with the adjusting spindle 28. In order to secure the position of the slide block 24 in the guide means 23, respectively set by means of the motor 29, a brake (not illustrated) is preferably provided.

Gripper members (not illustrated, however see the above-mentioned patents, for example U.S. Pat. No. 3,707,908 for gripper member constructions) are provided in conjunction with the turning device and the conveyor feed slide 2. In the direction of movement, each article being conveyed and turned has a length exceeding the length of the turning device taken in this same direction. This allows gripper members of the feed slide 2 to grip each article from both sides at the end portion and also allows gripper members of the turning device to grip each article from both sides at the middle portion. As seen in top plan view on both sides of the path of movement of the articles, one half of the turning device is situated with gripper members and outside of these parts the feed slide and associated gripper members is situated. Actuating of the gripping members may be mechanically derived from drive apparatus or controlled by electrical or hydraulic or pneumatic means in dependence on the operation of the drive apparatus. However, since the gripper members themselves and the actuation devices for same, of known construction, can be used, details thereof are not included herewith (also see the above-mentioned U.S. patents).

In the first embodiment of the apparatus of the invention illustrated in FIG. 1, coupling rod 26 is articulated, with its end facing away from the pin 25, to a leg of an angle lever 30 which is pivotally supported on a fixed point 31 intermediate the ends thereof. A guide rod 32 is joined with one of its ends to the other leg of the angle lever 30. The other end of the guide rod 32 is hingedly joined to a lever extension 33 of a tooth segment 35 mounted on a further fixed pivot point 34. A gear wheel 36 meshes with the tooth segment 35, which gear wheel is drivingly connected to pivot the turning device 27 about the fixed axis of rotation thereof.

Figure 2:
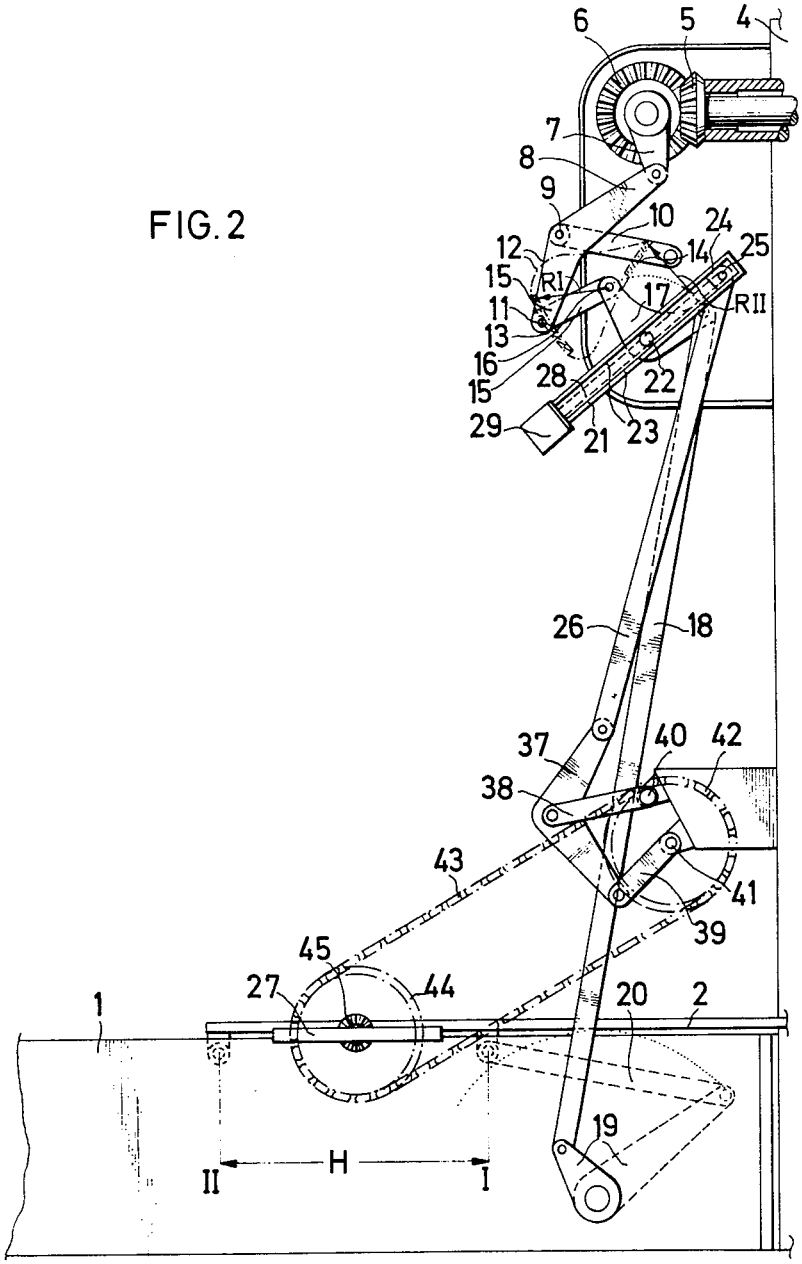
FIG. 2 is a side schematic view of a second embodiment of a conveying apparatus constructed in accordance with the present invention.
Figure 2A:
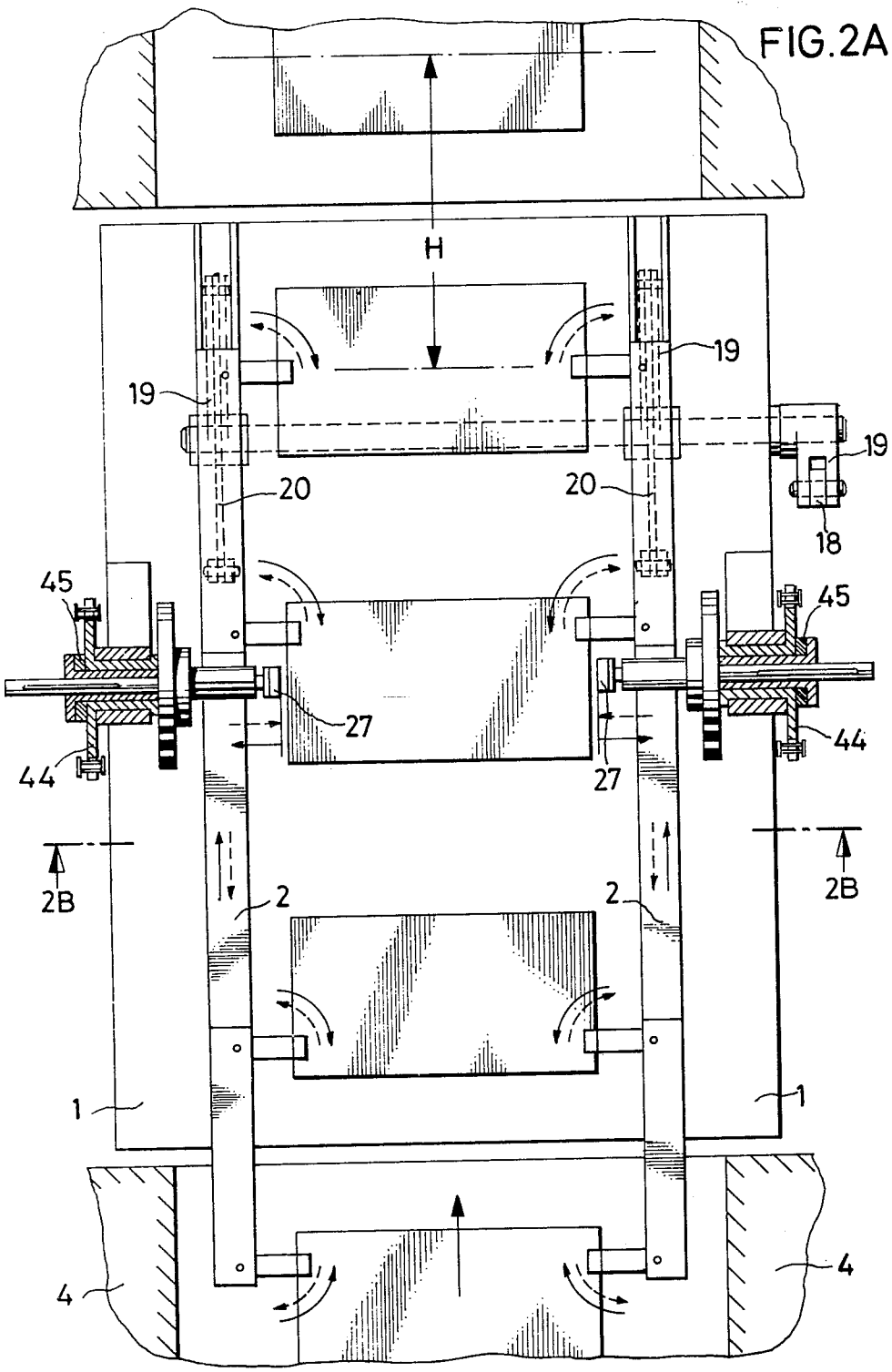
FIG. 2A is a partial sectional view taken in the downward direction of FIG. 2 and along line 2A—2A of FIG. 2B.
Figure 2B:
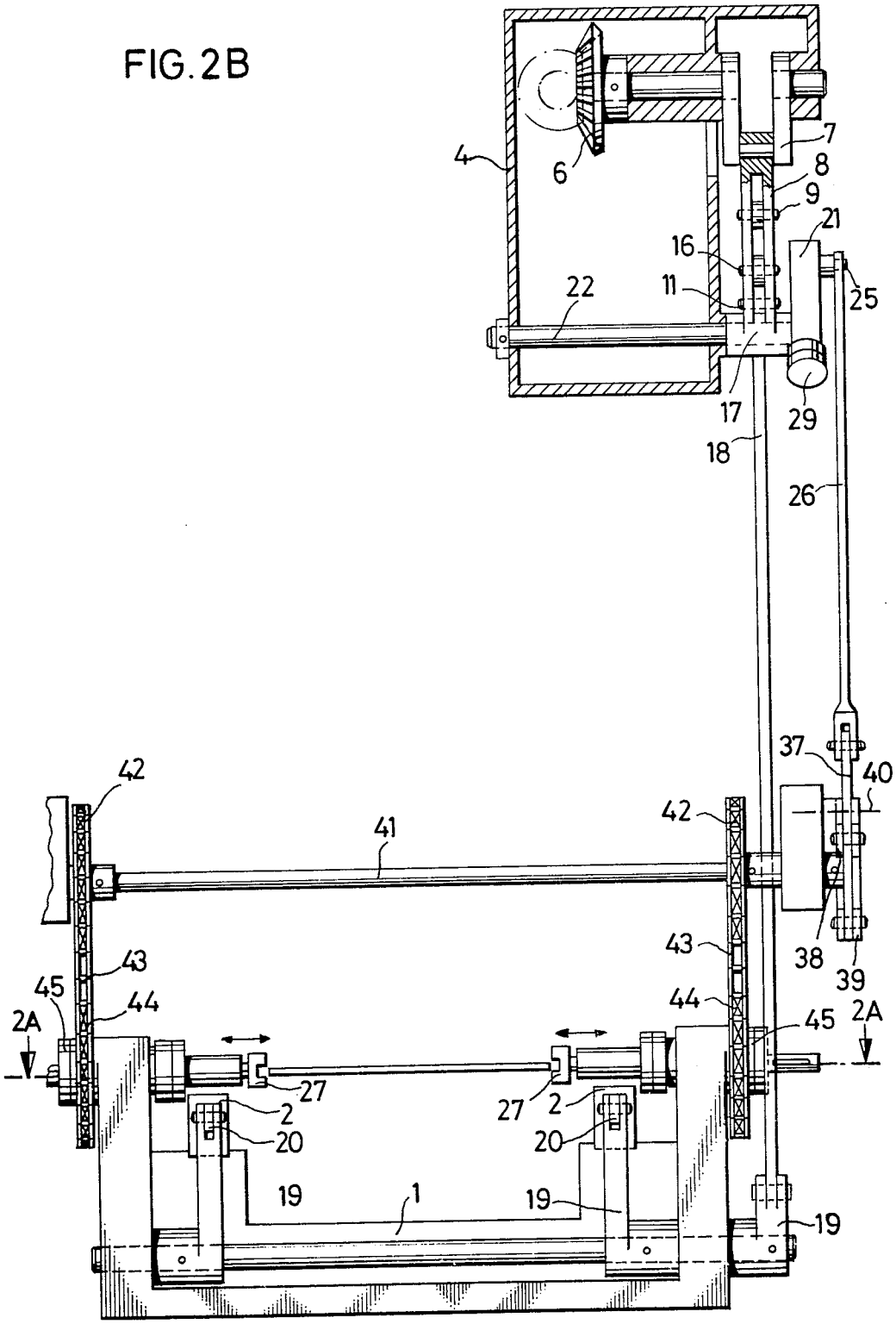
FIG. 2B is a view taken in the direction from left to right of FIG. 2 and along line 2B—2B of FIG. 2A.

In the second preferred embodiment of the invention shown in FIG. 2, the coupling rod 26 is articulated, with its end facing away from the pin 25, to a coupling member 37 of a quadrilateral bell crank linkage. The two pivot arms 38, 39 of the bell crank linkage are supported in respective fixed pivot points 40, 41. A sprocket wheel 42 is connected for rotation with the pivot arm 39 which swivels by about 180° in accordance with the design of the quadrilateral bell crank linkage. By means of a chain 43, this sprocket wheel 42 is in driving connection with an additional sprocket wheel 44. The turning device is joined to the sprocket wheel 44 via an adjustable gear coupling 45, thus effecting the pivoting of the turning device about the fixed axis of rotation thereof. The gear coupling 45 serves for setting the required initial position of the turning device.

In both of the illustrated preferred embodiments, the displacement of the slide block 24 in the guide means 23 serves, on the one hand, for setting the magnitude of the angle about which the turning device 27 is pivoted and, on the other hand, for selecting the direction in which the turning device 27 is pivoted during an advancing stroke H.

It will be understood that the operation of the gripper elements at the conveyor feed slide 2 and the turning device 27 are to be coordinated with the drive of the apparatus according to this invention so that, during the standstill in the stop point I, the gripper elements of the conveyor close and the gripper members of the turning device open, and during the arrest of the motion in stop point II, the gripper elements of the conveyor are opened and the gripper members of the turning device are closed. The feed slide 2 is of such a length that at least two sets of gripper elements are mounted thereto in sequence in the conveying direction, wherein one set feeds the articles to a turning device 27 and the other set carries the turned articles away from the operating zone of the turning device 27.

It is further noted that the kinematic layout of each of the illustrated embodiments results in the stopped position I and II during operation of the apparatus.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Apparatus for driving an automatic workpiece conveyor in a press train comprising:

drive means drivingly connectable to drive elements of a press, a first linkage member connected directly to said drive means for movement therewith, a second linkage member connected directly to a conveyor, and a plurality of further linkage members articulated to one another and to said first and second linkage members such that movement of said drive means is transmitted by way of said linkage members to drivingly move said conveyor over a predetermined path including two standstill positions for accommodating pick up and delivery of workpieces being conveyed by the conveyor, wherein said drive means is a rotatable member, wherein said linkage members are configured such that a coupling point of two of said members is constrained to move in a predetermined path including two arcuate sections spaced from one another and having the same radius of curvature, said coupling point moving along one of said arcuate sections with said conveyor stopped at a first of said standstill positions and said coupling point moving along the other of said arcuate sections with said conveyor stopped at the other of said standstill positions, wherein one of said members connected at said coupling point has the other end thereof connected to one end of a rocking lever which is rotatable about a fixed pivot axis intermediate the ends thereof, the other end of said rocking lever being connected to a linkage member drivingly connected to control movement of said conveyor in response to pivotal movement of said rocking lever about said fixed pivot axis, wherein a turning device is provided for turning a workpiece carried by said conveyor, wherein a secondary linkage system is interconnected between said rocking lever and said turning device for driving said turning device, said secondary linkage system including a two-armed lever with guide means extending in the longitudinal direction thereof beyond the axis of rotation of said two-armed lever, a slide block being displaceably arranged in the guide means which carries a pin for the hinged connection of a coupling rod in the drive train for said turning device.

2. Apparatus according to claim 1, wherein said two-armed lever is supported at said fixed pivot axis of said rocker arm.

3. Apparatus according to claim 1, wherein the slide block has an internal thread engaged by an adjusting spindle rotatably disposed in the two-armed lever.

4. Apparatus according to claim 3, wherein the mating of the internal thread with the thread of the adjusting spindle is self-locking.

5. Apparatus according to claim 4, wherein an adjusting motor is attached to the two-armed lever in driving connection with the adjusting spindle for rotating same with respect to the internal thread.

6. Apparatus according to claim 3, wherein an adjusting motor is attached to the two-armed lever in driving connection with the adjusting spindle for rotating same with respect to the internal thread.

7. Apparatus according to claim 3, wherein said secondary linkage system includes a linkage member attached at one end to one end of said two-armed lever for movement therewith, the other end of said last-mentioned linkage member being pivotally connected at one end at a further linkage member which is pivotable about an axis intermediate its ends, the other end of said further linkage member being connected to a still further linkage member which has teeth engageable with a rotatable gear wheel to turn said turning device.

8. Apparatus according to claim 7, wherein an adjusting motor is attached to the two-armed lever in driving connection with the adjusting spindle for rotating same with respect to the internal thread.

9. Apparatus according to claim 8, wherein each of said conveying and turning devices are provided with selectively engageable workpiece gripper means.

10. Apparatus according to claim 5, wherein said drive means and said conveyor are drivingly connected to one another exclusively by said linkage members.

11. Apparatus according to claim 6, wherein said drive means and said conveyor are drivingly connected to one another exclusively by said linkage members.

12. Apparatus according to claim 3, wherein said secondary linkage system includes a plurality of linkage members including a quadrilateral bell crank linkage, which has two pivot arms pivotally supported in fixed points, and wherein a sprocket wheel is connected for rotation with one of said pivot arms, a chain being provided which drivingly connects said sprocket wheel to drive said turning device.

* * * * *